US007845030B1

(12) United States Patent
Pollard

(10) Patent No.: US 7,845,030 B1
(45) Date of Patent: Dec. 7, 2010

(54) COLLAPSIBLE PLATFORM FOR A MATTRESS

(76) Inventor: Ronald L. Pollard, 97 Allison Rd., Brevard, NC (US) 28712

( * ) Notice: Subject to any disclaimer, the term of this patent is extended or adjusted under 35 U.S.C. 154(b) by 243 days.

(21) Appl. No.: 12/082,335

(22) Filed: Apr. 10, 2008

Related U.S. Application Data

(60) Provisional application No. 60/922,581, filed on Apr. 10, 2007.

(51) Int. Cl.
*A47C 19/00* (2006.01)

(52) U.S. Cl. ..... 5/308; 5/400; 5/2.1

(58) Field of Classification Search ..... 5/2.1, 5/9.1, 308, 400
See application file for complete search history.

(56) References Cited

U.S. PATENT DOCUMENTS 4,304,017 A 12/1981 Mortimer
4,613,999 A * 9/1986 Franco et al. ..... 5/400
4,788,727 A 12/1988 Liu
5,231,714 A * 8/1993 Mossbeck ..... 5/400
5,699,565 A 12/1997 Petterborg
5,774,913 A 7/1998 Allen et al.
6,457,192 B2 10/2002 Choi et al.
D472,746 S 4/2003 Hall
6,564,402 B1 5/2003 Lin
6,581,223 B1 6/2003 Wang
6,711,761 B2 3/2004 Choi
7,376,986 B2 * 5/2008 Smith et al. ..... 5/9.1

* cited by examiner

*Primary Examiner*—Fredrick Conley
(74) *Attorney, Agent, or Firm*—Montgomery Patent and Design, LLC; Robert C. Montgomery; Joseph T. Yaksich

(57) ABSTRACT

A collapsible and portable frame apparatus and storage system for bed mattresses replacing standard box springs is herein disclosed. The apparatus is intended for residential use or where space limitations restrict the delivery or movement of conventional box spring units. The apparatus consists of vertical sections that provide support for a platform for a conventional top mattress a typical distance above the floor. The perimeter base frame comprises attached lockable furniture casters and a plurality of interior compartments for storage. The apparatus comprises width adjustable inserts and is provided in a variety of sizes corresponding to common standard mattress sizes. The use of this apparatus with a mattress does not impede that making of the bed with standard bedding in a normal manner.

18 Claims, 7 Drawing Sheets

COLLAPSIBLE PLATFORM FOR A MATTRESS

RELATED APPLICATIONS

The present invention was first described in and claims the benefit of U.S. Provisional Application No. 60/922,581 filed on Apr. 10, 2007, the entire disclosures of which are incorporated herein by reference.

FIELD OF THE INVENTION

The present invention relates generally to a collapsible and portable frame apparatus for bed mattresses and, more particularly, to said frame apparatus that replaces a conventional box-spring and also comprising integral storage compartments.

BACKGROUND OF THE INVENTION

In the United States, relocation ranks as the third most stressful life event. Forty-two million (42,000,000) people move each year in the U.S.—one (1) in four (4) adults. The average individual will move eleven-point-seven (11.7) times in their lifetime. With any move comes the loading and unloading of furniture. One (1) of the most cumbersome items to move is a bed. Moving a bed system comprised of a mattress and a box-spring is a challenging task even in residences with wide hallways and staircases. Attempting to move a bed set in homes with narrow hallways and staircases can be virtually impossible. This is especially true for the box-spring component with its rigid, non-conforming nature. In such instances, people resort to smaller beds, or place the mattress directly on the floor, or turn to a cobbled together system of supports which may include cinder blocks, milk crates and wooden planks. None of these are acceptable solutions.

Accordingly, there is a need for a means by which mattresses can be supported by a frame system in homes with limited access without the disadvantages as described above. The development of the invention herein described fulfills this need.

U.S. Pat. No. 6,711,761 filed by Choi discloses an inclining bed with collapsible frame. This patent does not appear to disclose a collapsible platform for a mattress which incorporates a solid platform supported by a support structure capable of conveniently folding to a flat position.

U.S. Pat. No. 6,581,223 filed by Wang discloses a foldable frame assembly. This patent does not appear to disclose a collapsible platform for a mattress which incorporates a solid platform supported by a support structure capable of conveniently folding to a flat configuration.

U.S. Pat. No. 6,564,402 filed by Ling discloses a foldable bed frame device. This patent does not appear to disclose a collapsible platform for a mattress which incorporates a solid platform supported by a support structure capable of conveniently folding to a flat configuration.

U.S. Pat. No. D 472,746 filed by Hall discloses a device for supporting bedding. This design patent does not appear to disclose an apparatus capable of supporting a mattress nor does this design patent look similar to the invention herein described.

U.S. Pat. No. 6,457,192 filed by Choi and Lamke discloses an air bed with elevated and self-expanding support structure. This patent does not appear to disclose a collapsible platform for a mattress which incorporates a solid platform supported by a support structure capable of conveniently folding to a flat configuration.

U.S. Pat. No. 5,774,913 filed by Allen and Allen discloses a bedspread holding device. This patent does not appear to disclose an apparatus capable of supporting a mattress.

U.S. Pat. No. 5,699,565 filed by Petterborg discloses a collapsible bedspread holder. This patent does not appear to disclose an apparatus capable of supporting a mattress.

U.S. Pat. No. 4,788,727 filed by Anderson discloses a collapsible base for beds. This patent does not appear to disclose a collapsible platform for mattresses which collapsible through the use of integral hinges position upon the support members.

U.S. Pat. No. 4,304,017 filed by Mortimer discloses a collapsible structure particularly for use as a cot or bed. This patent does not appear to disclose an apparatus capable of supporting a mattress nor does it appear that this apparatus is a collapsible platform capable of utilizing hinges to easily fold to a flat configuration.

The prior art appears to disclose apparatus that serve a more temporary use than the instant invention. The prior art does not appear to provide for a collapsible platform supported by a sound support system possessing integral hinges that permit the apparatus to collapse to a flat configuration.

SUMMARY OF THE INVENTION

In view of the foregoing disadvantages inherent in the prior art, it has been observed that there is need for a solid, collapsible platform for a mattress that conveniently folds to a flat configuration.

The collapsible platform for a mattress provides a compact storage means while replacing a standard box-spring. The collapsible platform for mattresses is intended for residential use or where space limitations restrict the delivery or movement of conventional box spring units.

The collapsible platform for a mattress comprises a plurality of vertical sections supporting an upper platform positioning and supporting a conventional top mattress thereupon at a typical distance above a floor surface. The support structure portion of the collapsible platform for mattresses comprises a first insert and a second insert, each located at opposing ends of the collapsible platform for mattresses. The collapsible platform for mattresses further comprises lockable furniture casters and a plurality of interior compartments for storage.

A further aspect of the collapsible platform for a mattress comprises a plurality of compartment doors, four (4) first platform boards, and a pair of second platform boards. The first platform boards comprise rectangular shapes having a single rounded corner for positioning at each corner portion of the platform having a flush edge thereto the support structure along a headboard end and having an overhanging edge portion along three (3) remaining edges. The second platform boards are positioned therebetween said first platform boards, thereby establishing a continuous flat surface having a desired length.

Still a further aspect of the collapsible platform for a mattress is to provide a plurality of models corresponding thereto standard bed sizes such as, but not limited to: single, double, queen, and king sizes. The first and second platform boards would be supplied in corresponding dimensions in order to accommodate the particular mattress size desired.

Yet still another aspect of the collapsible platform for a mattress is to provide said first and second platform boards comprising an attachment means thereto the support structure via a plurality of fasteners and an attachment means thereto an anti-skid cover via a plurality of common male snap fixtures. The male snap fixtures are located along a top perimeter region of the assembled first and second platform boards.

Another object of the collapsible platform for a mattress comprises a foldable and collapsible rectangular support structure further comprising: two (2) first box supports, four (4) second box supports, six (6) storage compartment doors, four (4) platform supports, four (4) caster boards, three (3) floorboards, four (4) first hinges, eight (8) second hinges, a first insert, and a second insert. The rectangular support structure provides a collapsible and compact assembly allowing a user to conveniently store the collapsible platform for mattresses or transport. The first box support boards comprises vertical rectangular panels being located along each side area and provide an attachment means for said plurality of storage compartment doors.

Yet another object of the collapsible platform for a mattress comprises said storage compartment doors to further comprise a common rectangular design with expected features such as a pair of third hinges, a knob, and a common clasp closure.

Still yet another object of the collapsible platform for a mattress further comprises two (2) pairs of first slots located along inward facing surfaces and providing an attachment means thereto the platform supports. The pairs of first slots are arranged so as to divide the inner surface of the first box support into three (3) equal sections.

Still yet another object of the collapsible platform for a mattress further comprises four (4) second slots located along inward facing surfaces and extending horizontally and located along a bottom inside edge of the first box supports. The second slots are located at each outer corner region of the first box support and at a base area of each pair of first slots and are sized so as to slidingly receive an end portion of a caster board therein.

Still yet another object of the collapsible platform for a mattress provides for said platform supports arranged perpendicular thereto, and spanning therebetween, opposing first box supports. The platform supports comprise rectangular shapes and are correspondingly slidingly inserted therein the first slots in a parallel arrangement and defining a set width of the support structure in a stable rectangular form.

Still yet another object of the collapsible platform for a mattress provides for four (4) caster boards extending therebetween opposing first box supports and further comprising a pair of locking casters, thereby allowing the collapsible platform to be easily transported along a floor surface or secured in position to avoid unwanted movement.

The casters provide an attachment means being flange-mounted thereto a lower surface of said caster boards at end portions thereof.

Still yet another object of the collapsible platform for a mattress provides for said two (2) first box support boards comprising major side portions of the rectangular support structure and provide a hinging attachment means at each end portion to a pair of second box support boards and said second support boards comprising minor side portions of said rectangular support structure being coincidental therewith headboard and footboard positions on conventional bedding. Each pair of second box support boards further comprise a folding and adjustable width via a pair of first hinges positioned at a footboard area of the collapsible platform providing an attachment means thereto a first insert and an additional pair of first hinges positioned at a headboard area providing an attachment means thereto a second insert.

Still yet another object of the collapsible platform for a mattress, provides for said inserts comprising "Z"-shaped vertical sections being inserted therebetween adjacent second box support portions and being affixed thereto along a vertical non-hinged edge.

Still yet another object of the collapsible platform for a mattress provides for said floorboards comprising a bottom horizontal surface therewithin the collapsible platform for mattresses allowing contained storage of personal items therewithin being accessed using the compartment doors. The floorboards comprise rectangular shapes forming a floor and being supported by the four (4) caster boards and being positioned therebetween the first box supports, the second box supports, and the platform supports.

The support structure is envisioned to be provided in a variety of painted colors and patterns and made using preferably wood materials; however, said support structure members may be provided using alternative materials such as aluminum, plastic, fiberglass, or the like.

A further aspect of the collapsible platform for a mattress further comprises an anti-skid cover portion, comprising a flexible sheet of high-friction materials having a perimeter edge being coincidental thereto the platform boards and a plurality of female snap fixtures affixed thereto a bottom surface along a perimeter region thereof so as to align and be engaged thereto the aforementioned male snap fixture portions mounted thereto the platform boards.

The collapsible platform for mattresses may be utilized with conventional mattress/bedding or a footboard or headboard may be added as shown to provide a decorative and aesthetic appearance based upon a user's preference.

A method for installing, erecting, and utilizing a collapsible platform for a mattress may be used by performing the following steps: procuring a particular model, or models, of the collapsible platform corresponding thereto particular desired bed sizes; procuring one (1) or more inserts having a width which also corresponds thereto said desired bed sizes, as needed; locating a desired room providing sufficient area in which to set up the collapsible platform; assembling the insert portions thereinto the second box supports using the provided fasteners, if not previously assembled; unfolding and expanding the support structure to form a rectangular periphery; lifting the first box supports from a floor surface; inserting the four (4) caster boards thereinto the second slot portions of the first box supports; inserting the platform supports downwardly thereinto the first slots until contacting the caster boards; affixing the platform boards thereto the support structure using the provided fasteners; attaching the anti-skid cover thereto the platform boards by engaging the male and female snap fixtures; placing conventional mattress/bedding thereupon the collapsible platform; placing additional foot/headboard members, if desired; and, benefiting from improved compact storage and convenient portability of a bed platform afforded a user of the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
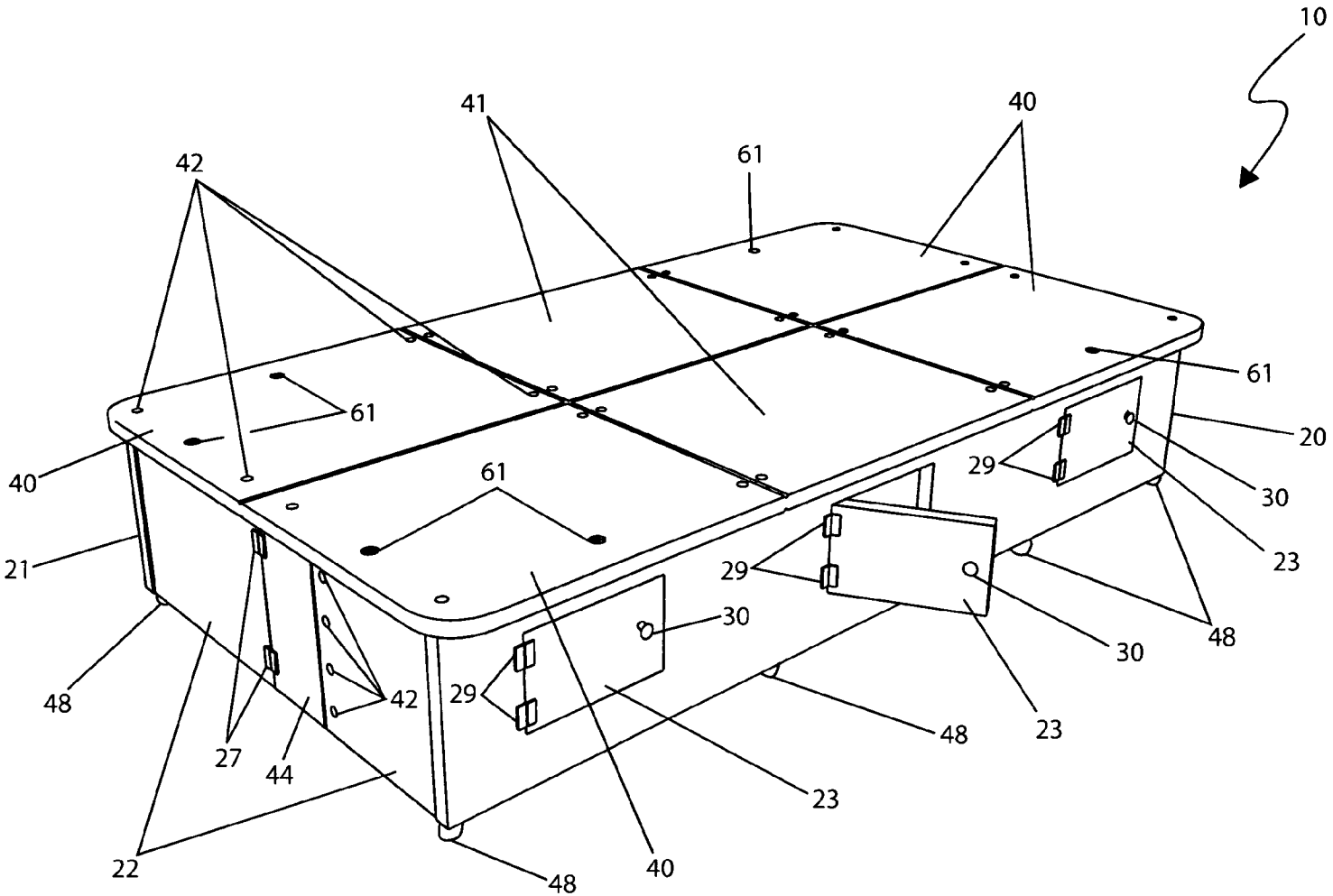
FIG. 1 is a side perspective view of the collapsible platform for a mattress 10, according to a preferred embodiment of the present invention.
Figure 2:
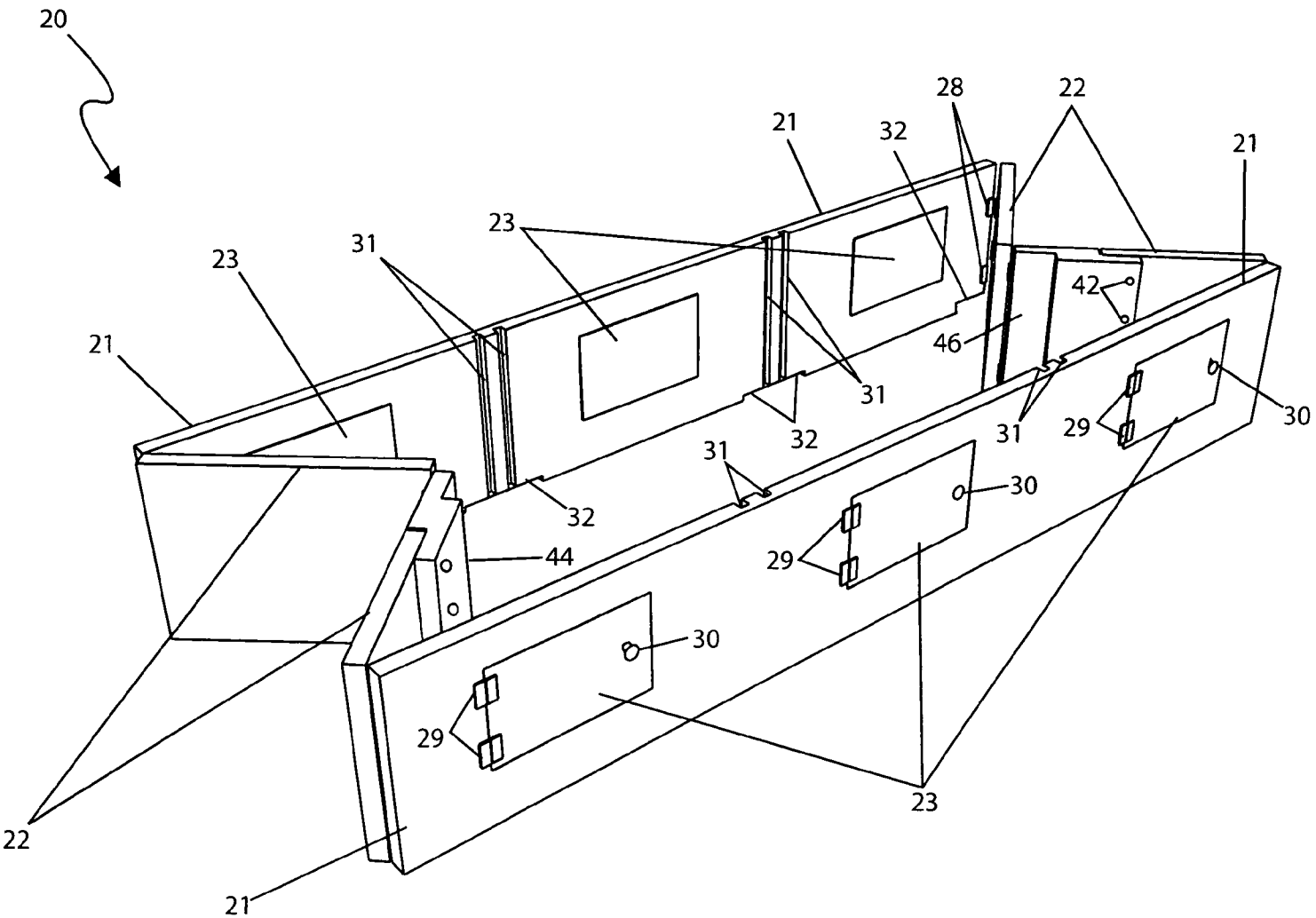
FIG. 2 is a perspective view of a support structure portion 20 depicting a folded state, according to a preferred embodiment of the present invention.
Figure 3:
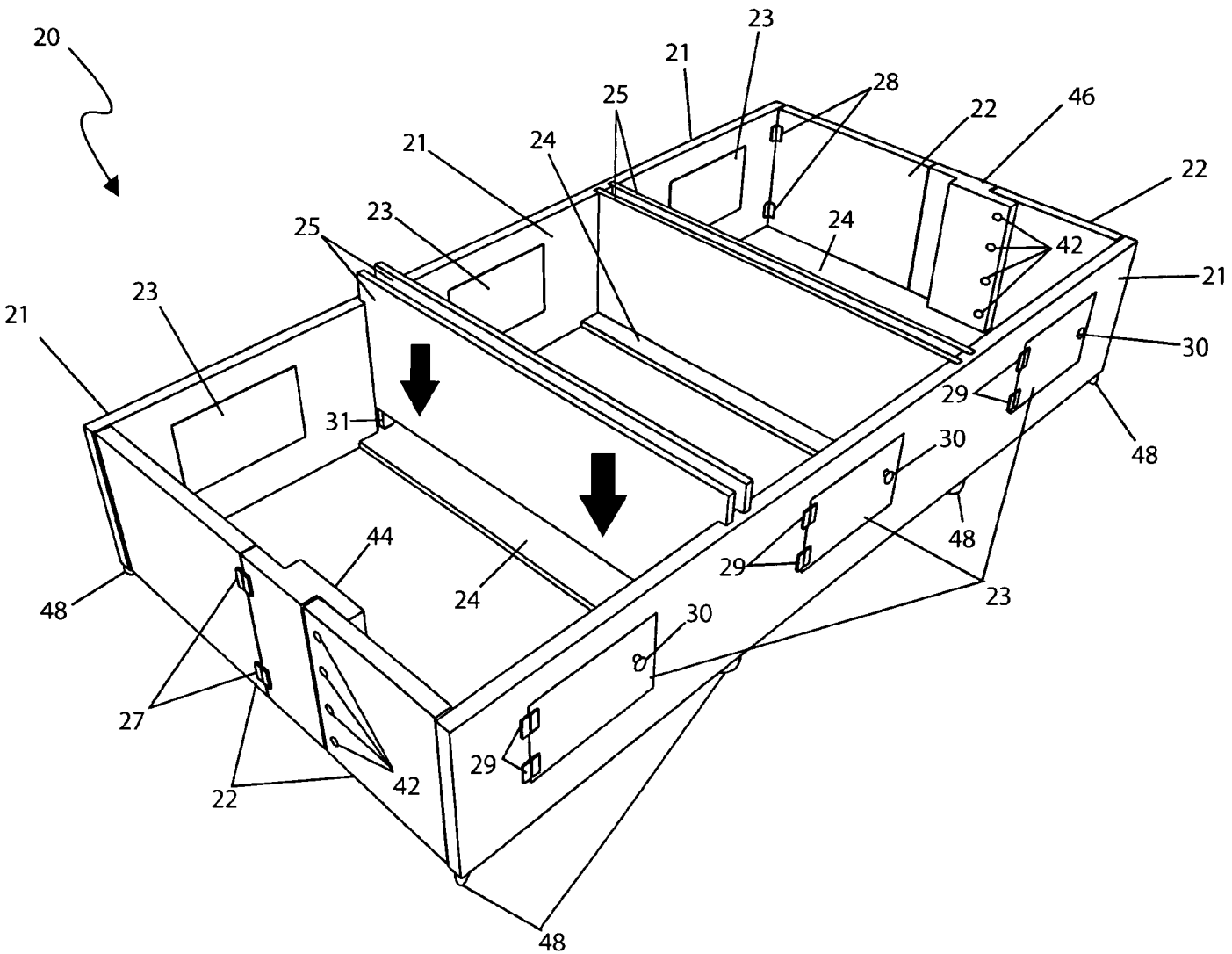
FIG. 3 is a perspective view of a partially assembled structure portion 20, according to a preferred embodiment of the present invention.
Figure 4:
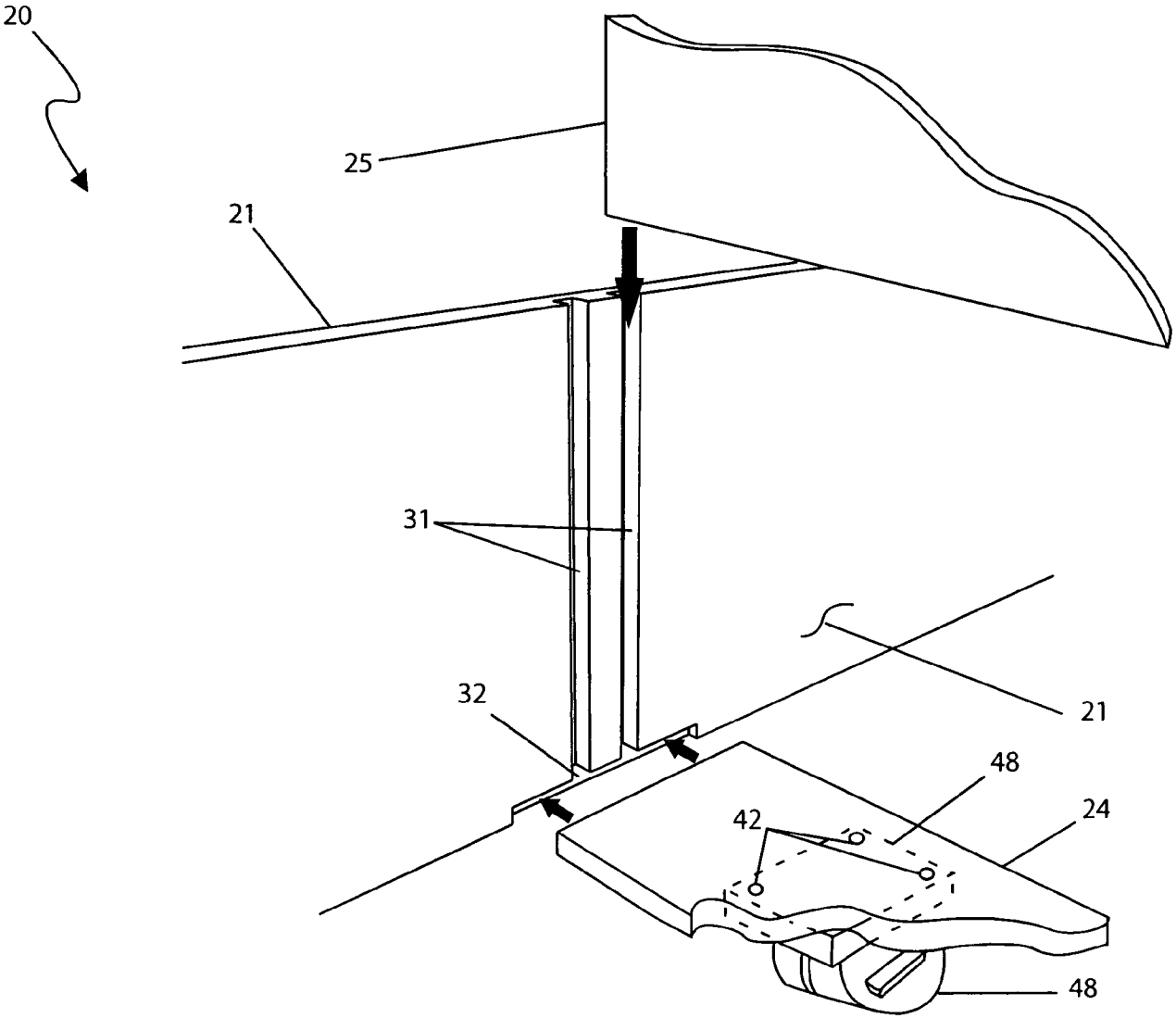
FIG. 4 is a close-up view of a first box support 21 and attached members, according to a preferred embodiment of the present invention.
Figure 5:
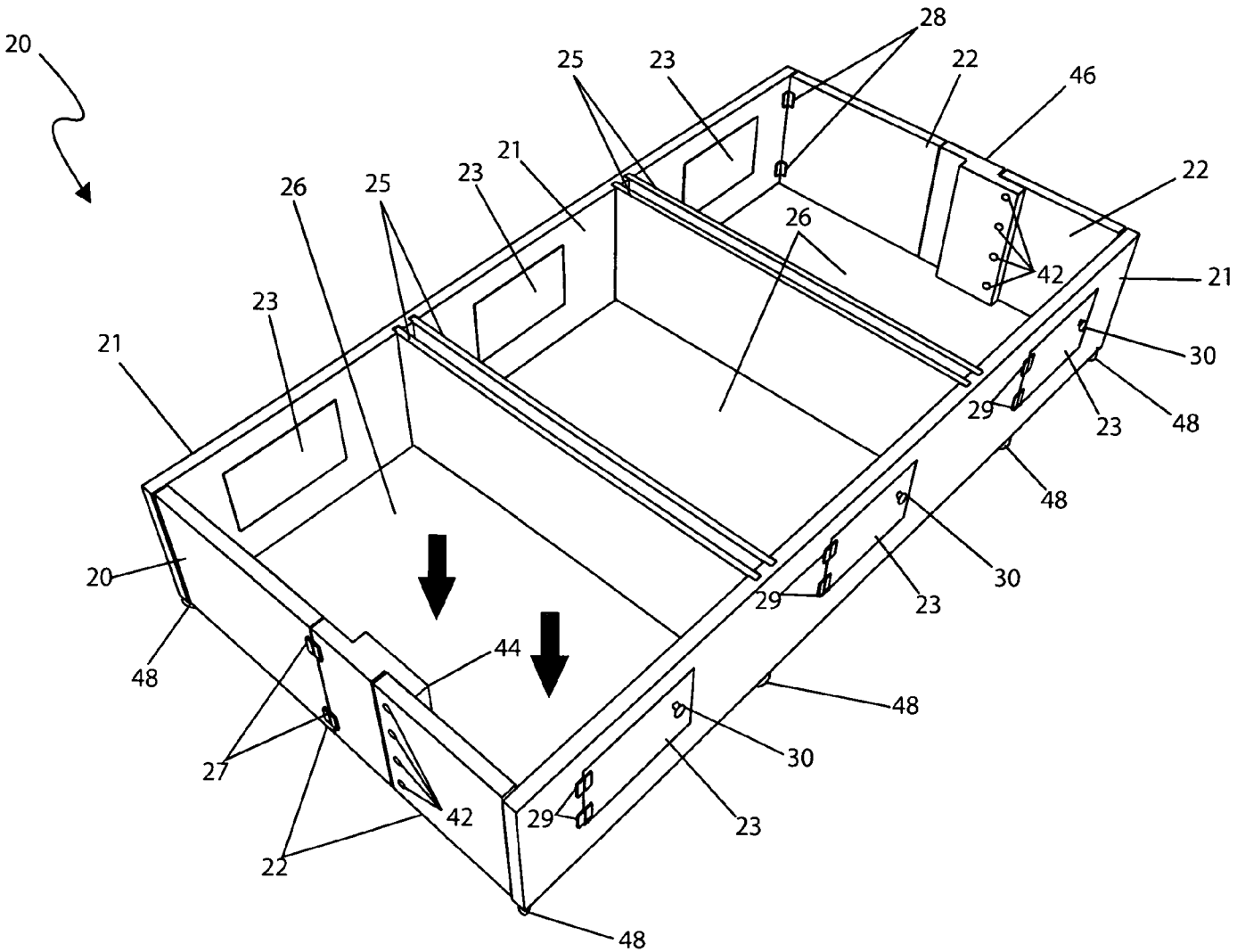
FIG. 5 is a perspective view of a fully assembled structure portion 20, according to a preferred embodiment of the present invention.

10 collapsible platform for a mattress
20 support structure
21 first box support
22 second box support
23 compartment door
24 caster boards
25 platform support
26 floorboard
27 first hinge
28 second hinge
29 third hinge
30 knob
31 first slot
32 second slot
40 first platform board
41 second platform board
42 fastener
44 first insert
46 second insert
48 caster
50 mattress/bedding
51 foot/headboard
60 anti-skid cover
61 male snap fixture
62 female snap fixture

DETAILED DESCRIPTION OF THE PREFERRED EMBODIMENT

The best mode for carrying out the invention is presented in terms of its preferred embodiment, herein depicted within FIGS. 1 through 6*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a collapsible platform for a mattress (herein described as the "apparatus") 10, comprising a compact storage means while replacing a standard box-spring. The apparatus 10 is intended for residential use or where space limitations restrict the delivery or movement of conventional box-spring units. The apparatus 10 comprises a plurality of vertical sections supporting an upper platform positioning and supporting a conventional top mattress 50 thereupon at a typical distance above a floor surface. The support structure portion 20 of the apparatus 10 comprises a first insert 44 and a second insert 46, each located at opposing ends of the apparatus 10, thereby providing a variety of width dimensions corresponding thereto common standard mattress sizes 50. The apparatus 10 further comprises lockable furniture casters 48 and a plurality of interior compartments 23 for storage. The use of the apparatus 10 with a mattress 50 does not impede normal making of a bed using standard bedding elements.

Referring now to FIG. 1, a side perspective view of the apparatus 10, according to the preferred embodiment of the present invention, is disclosed. The apparatus 10 comprises a support structure 20, a plurality of compartment doors 23, four (4) first platform boards 40, and a pair of second platform boards 41. The support structure 20 further provides support thereto a sturdy horizontal platform comprising a plurality of platform boards 40, 41 on which to place conventional mattress/bedding portions 50. The first platform boards 40 comprise rectangular shapes preferably made using plywood and comprising dimensions of approximately three-quarters (¾) of an inch thick having a single rounded corner for positioning at each corner portion of the platform. The first platform boards 40 are positioned having a flush edge thereto the support structure 20 along a headboard end and having an overhanging edge portion along three (3) remaining edges of approximately three (3) to four (4) inches. The second platform boards 41 are positioned therebetween said first platform boards 40, thereby establishing a continuous flat surface having a desired length. It is understood that the apparatus 10 is to be provided in a plurality of models which correspond thereto standard bed sizes such as, but not limited to: single, double, queen, and king sizes. Said models of the apparatus 10 would be provided having different quantities and sizes of first 40 and second 41 platform boards resulting in an assembly having desired a perimeter dimension. The first 40 and second 41 platform boards provide an attachment means thereto the support structure 20 via a plurality of fasteners 42 comprising flathead hardware being recessed and flush with a top surface of said first 40 and second 41 platform boards. The fasteners 42 may be quickly installed using common tools such as a screwdriver, alien wrench, or the like. The first 40 and second 41 platform boards further provide an attachment means thereto an anti-skid cover 60 via a plurality of common male snap fixtures 61 (see FIG. 6*a*). The male snap fixtures 61 are located along a top perimeter region of the assembled first 40 and second 41 platform boards being attached thereto using common fasteners 42 such as screws, rivets, or the like.

Referring now to FIGS. 2 through 5, perspective views of various assembled states of the apparatus 10, according to the preferred embodiment of the present invention, are disclosed. The apparatus 10 comprises a foldable and collapsible rectangular support structure 20 further comprising two (2) first box supports 21, four (4) second box supports 22, six (6) storage compartment doors 23, four (4) platform supports 25, four (4) caster boards 24, three (3) floorboards 26, four (4) first hinges 27, eight (8) second hinges 28, a first insert 44, and a second insert 46. The rectangular support structure 20 provides a collapsible and compact assembly allowing a user to conveniently store the apparatus 10 or transport through narrow hallways. The first box support boards 21 comprises vertical rectangular panels made using plywood being located along each side area of the apparatus 10 provide an attachment means for a plurality of storage compartment doors 23 providing an internal storage means thereto the apparatus 10. The storage compartment doors 23 comprise a common rectangular design with expected features such as a pair of third hinges 29, a knob 30, and a common clasp closure hardware arrangement. The storage compartment doors 23 are to be sized in proportion to the support structure 20 as well as the user's preferences. Each first box support 21 further comprises two (2) pairs of first slots 31 and four (4) second slots 32 along inward facing surfaces. The first slots 31 provide an attachment means thereto the platform supports 25. The first slots 31 are approximately one (1) inch wide and cut to a depth of approximately one-half (½) of a thickness of the first box supports 21. The first slots 31 are arranged in pairs being approximately two (2) inches apart. The pairs of first slots 31 are arranged so as to divide the inner surface of the first box support 21 into three (3) equal sections. The platform supports 25 are arranged perpendicular thereto, and spanning therebetween opposing first box supports 21. The platform supports 25 comprise rectangular shapes made using similar materials as the first box supports 21 and being inserted slidingly therein the first slots 31 in parallel fashion and defining a set width of the support structure 20 in a stable rectangular form. The four (4) second slots 32 extend horizontally and are approximately one (1) inch high and six (6) inches wide being located along a bottom inside edge of the first box supports 21. The second slots 32 are located at each outer corner region of the first box support 21 and at a base area of each pair of first slots 31. The second slots 32 are sized so as to slidingly receive an end portion of a caster board 24 therein. The four (4) caster boards 24 extend therebetween opposing first box supports 21 in like manner as the aforementioned first box supports 21. Each caster board 24 comprises a pair of common commercially available locking casters 48 allowing the apparatus 10 to be easily moved along a floor surface or locked in position to avoid unwanted movement. The casters 48 provide an attachment means being flange-mounted thereto a lower surface of said caster boards 24 at end portions thereof using common fasteners 42 such as screws, bolts, or the like.

The two (2) first box support boards 21 provide major side portions of the rectangular support structure 20 and provide a hinging attachment means at each end portion to a pair of second box support boards 22 via pairs of first hinges 27 along joining vertical corner regions. The second support boards 21 make up the minor sides of said rectangular support structure 20 being coincidental therewith headboard and footboard positions on conventional bedding 51 (see FIG. 6*b*). Each pair of second box support boards 22 further comprise a folding and adjustable width means via a pair of intermediately located first hinges 27 and inserts 44, 46. Each first hinge 27 is envisioned to be a common hardware item made of plated steel, brass, or the like, being affixed using common fasteners 42 such as screws, bolts, or the like. A pair of first hinges 27 is positioned at a footboard area of the apparatus 10 providing an attachment means thereto a first insert 44. An additional pair of first hinges 27 is positioned at a headboard area providing an attachment means thereto the second insert 46. The inserts 44, 46 comprise different widths, thereby providing a variable width means thereto the support structure 20 assembly and may be purchased individually or in multiple sizes so as to allow a user to utilize various corresponding standard bed sizes. The inserts 44, 46 comprise "Z"-shaped vertical sections being inserted therebetween adjacent second box support portions 22 and being affixed thereto along a vertical non-hinged edge using common fasteners 42 such as screws. The inserts 44, 46 are envisioned being made using similar materials as the aforementioned box supports 21, 22. The floorboards 26 provide a suitable bottom horizontal surface therewithin the apparatus 10 allowing contained storage of personal items therewithin being accessed using the compartment doors 23. The floorboards 26 comprise rectangular shapes preferably using plywood sheets forming a floor and being supported by the four (4) caster boards 24 and being positioned therebetween the first box supports 21, the second box supports 22, and the platform supports 25.

The support structure 20 is envisioned to be provided in a variety of painted colors and patterns and made using preferably wood materials; however, said support structure members 20 may be provided using alternative materials such as aluminum, plastic, fiberglass, or the like.

Figure 6A:
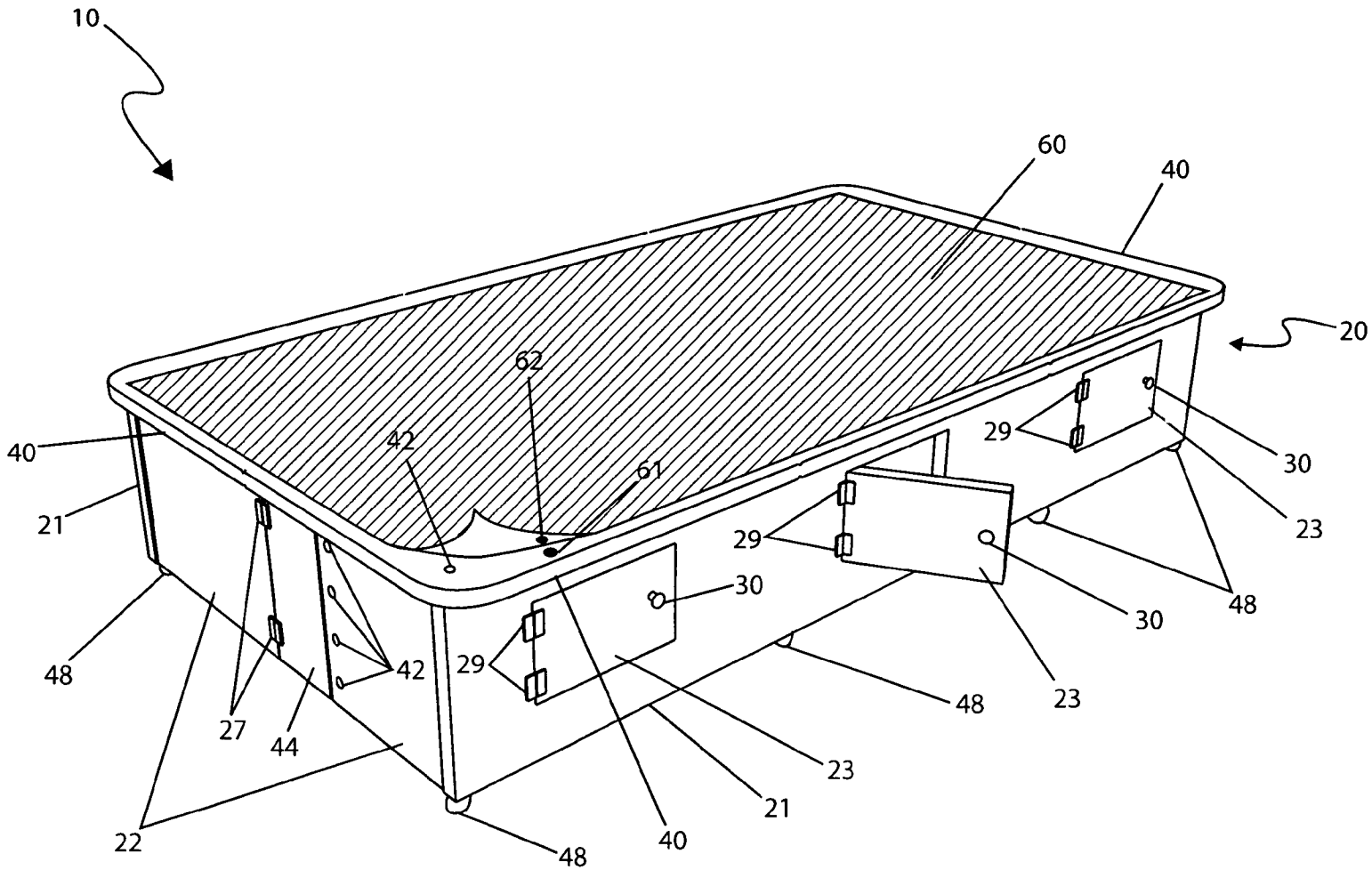
FIG. 6*a* is a side perspective view of the collapsible platform for a mattress 10 depicting an anti-skid cover portion 60, according to a preferred embodiment of the present invention; and, FIG. 6*b* is an environmental view of the collapsible platform for a mattress 10, depicting applied conventional mattress/bedding portions 50, according to a preferred embodiment of the present invention.

Referring now to FIG. 6*a*, a side perspective view of the apparatus 10 depicting an anti-skid cover portion 60, according to a preferred embodiment of the present invention, is disclosed. The anti-skid cover 60 comprises a flexible sheet having a perimeter edge being coincidental thereto the platform boards 40, 41 preventing possible sliding of conventional mattress/bedding elements 50 during use. The anti-skid cover 60 is envisioned being made using high-friction materials such as, but not limited to: latex impregnated fabric, rubber sheet, urethane sheet, or the like. The anti-skid cover 60 further comprises a plurality of female snap fixtures 62 affixed thereto a bottom surface along a perimeter region thereof using common textile processes such as adhesives, sewing, swaging. The female snap fixtures 62 are positioned so as to align and be engaged thereto the aforementioned male snap fixture portions 61 mounted thereto the platform boards 40, 41.

Figure 6B:
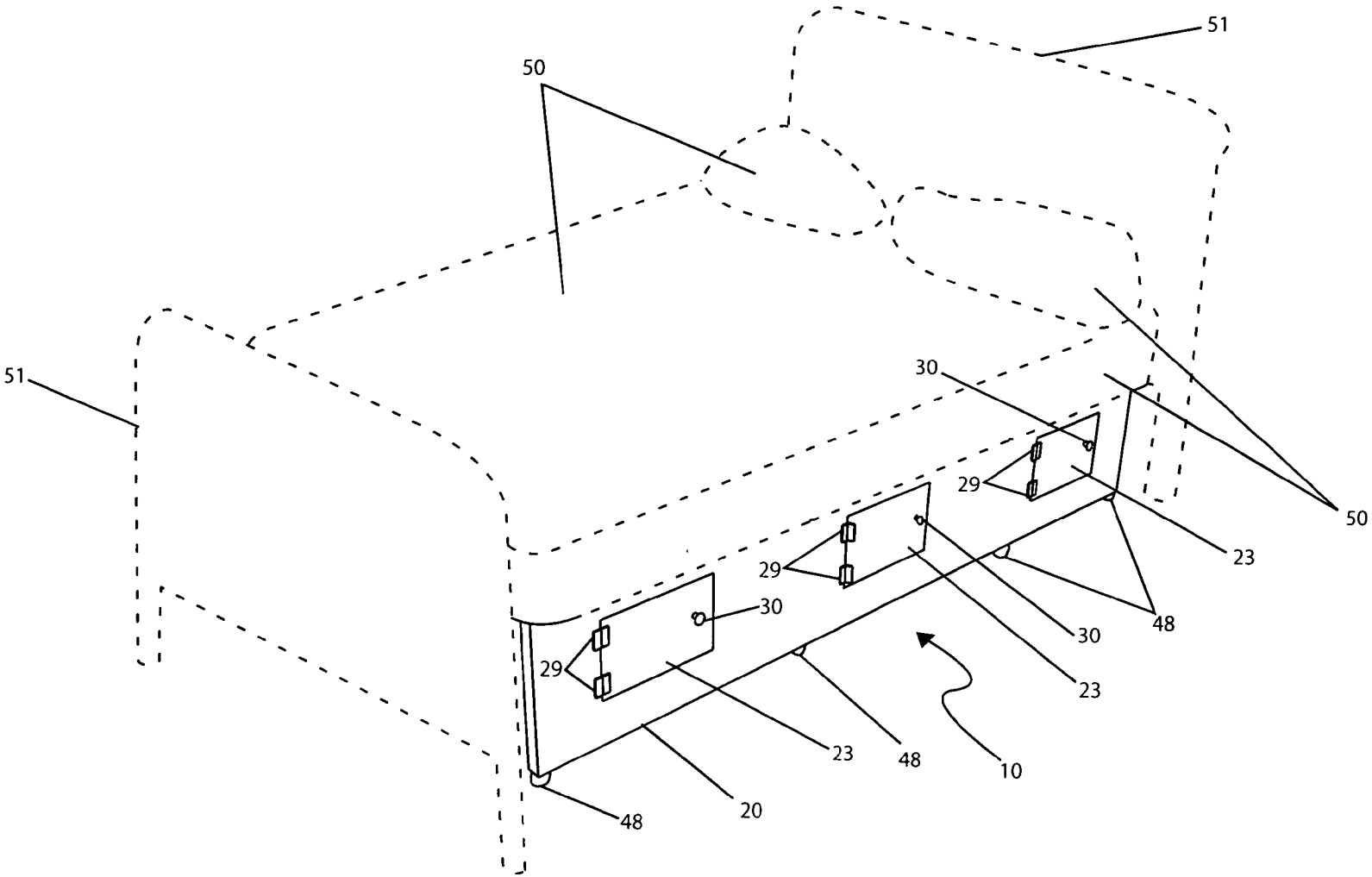

Referring now to FIG. 6*b*, an environmental view of the apparatus 10 depicting applied conventional mattress/bedding portions 50, according to a preferred embodiment of the present invention, is disclosed. The apparatus 10 may be utilized with conventional mattress/bedding 50 or a footboard or headboard 51 may be added as shown to provide a decorative and aesthetic appearance based upon a user's preference.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 6*b*.

The method of installing and utilizing the apparatus 10 may be achieved by performing the following steps: procuring a particular model, or models, of the apparatus 10 corresponding thereto particular desired bed sizes such as single, double, queen, or king; procuring one (1) or more inserts 44, 46 having a width which also corresponds thereto said desired bed sizes, as needed; locating a desired room providing sufficient area in which to set up the apparatus 10; assembling the insert 44, 46 portions thereinto the second box supports 22 using the provided fasteners 42, if not previously assembled; unfolding and expanding the support structure 20 to form a rectangular periphery; lifting the first box supports 21 from a floor surface; inserting the four (4) caster boards 24 thereinto the second slot portions 32 of the first box supports 21; inserting the platform supports 25 downwardly thereinto the first slots 31 until contacting the caster boards 24; affixing the platform boards 40, 41 thereto the support structure 20 using the provided fasteners 42; attaching the anti-skid cover 60 thereto the platform boards 40, 41 by engaging the male 61 and female 62 snap fixtures; placing conventional mattress/bedding 50 thereupon the apparatus 10; placing additional foot/headboard members 51, if desired; and benefiting from improved compact storage and convenient portability of a bed platform afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A collapsible and transportable platform assembly for a mattress, further comprising:

a support structure, further comprising:

a pair of first box supports, comprising an upper end and a lower end;

a pair of second upper box supports hingedly attached thereto said upper end of said first box supports, further comprising a bifurcating upper central hinge; and, a pair of second lower box supports hingedly attached thereto said lower end of said first box supports, further comprising a bifurcating lower central hinge;

an upper insert attached thereto said bifurcating upper central hinge of said second upper box supports;

a lower insert attached thereto said bifurcating lower central hinge of said second lower box supports;

four (4) first platform boards supported thereby and attachable thereto said support structure; and, a pair of second platform boards supported thereby and attachable thereto said support structure;

wherein when said support structure is fully extended a width and a confined space is defined thereof;

wherein said support structure hingedly collapses into a compact storage configuration;

wherein said upper insert and said lower insert provide a variable width means thereto said support structure;

wherein said first platform boards and second platform boards when installed to establish a continuous flat surface combine to form a mattress platform; and, wherein said mattress platform supports said mattress laid thereupon at a typical distance above a floor surface.

2. The assembly of claim 1, further comprising an anti-skid cover comprising an fastening means thereto said mattress platform.

3. The assembly of claim 1, wherein said support structure further comprises:

a plurality of first slots located along inward facing surfaces of said first box supports; and, a plurality of platform supports slidingly inserted therein said plurality of first slots;

wherein said plurality of first slots are spaced so as to provide an attachment means thereto and enable said platform supports to correspondingly span said width of said support structure.

4. The assembly of claim 3, wherein said plurality of first slots are spaced so as to divide said confined space of said support structure into equally-sized sections.

5. The assembly of claim 4, further comprising a plurality of compartment doors hingedly connected thereto an outer surface of said pair of first box supports each comprising a knob and a secure closure mechanism;

wherein said plurality of compartment doors are centrally positioned therein said equally-sized sections;

wherein said plurality of compartment doors provides access thereinto said confined space thereof said support structure.

6. The assembly of claim 1, wherein said support structure further comprises;

a plurality of second slots extending horizontally located along a bottom inside edge of said first box supports;

a plurality of caster boards sized so as to slidingly insert an end portion of said caster board therein said plurality of second slots; and, a pair of locking caster wheel assemblies attached thereto a bottom surface of each of said plurality of caster boards;

wherein said plurality of second slots are spaced so as to provide an attachment means thereto and enable said caster boards to correspondingly span said width of said support structure.

7. The assembly of claim 6, wherein said support structure further comprises a plurality of floorboards attachable thereto said plurality of caster boards and spanning said width of said support structure;

wherein said plurality of floorboards provide a suitable bottom horizontal surface thereof said support structure.

8. The assembly of claim 1, wherein said first platform boards comprise rectangular shapes having a single rounded corner for positioning at each corner portion of said support structure and further comprising:

a flush edge thereto said support structure along a headboard end; and, an overhanging edge portion along three (3) remaining edges.

9. The assembly of claim 8, wherein said second platform boards comprise rectangular shapes and are positioned therebetween said first platform boards thereon said support structure, such that said second platform boards provide a continuous flush edge therewith said first platform boards.

10. The assembly of claim 9, wherein said first and second platform boards each further comprise a plurality of fastening means located therealong a top perimeter region of each of said first and second platform boards therefor an anti-skid cover.

11. The assembly of claim 10, wherein said first and second platform boards comprise dimensions corresponding to conventional bed sizes consisting of one of the following list: single, double, queen, and king.

12. A method of assembling, utilizing, storing, and transporting a collapsible platform assembly for a mattress comprises the following steps:

providing said collapsible platform assembly comprising:

a support structure comprising a width corresponding to a desired bed size, further comprising:

a pair of first box supports, comprising an upper end and a lower end;

a pair of second upper box supports hingedly attached thereto said upper end of said first box supports, further comprising a bifurcating upper central hinge; and, a pair of second lower box supports hingedly attached thereto said lower end of said first box supports, further comprising a bifurcating lower central hinge;

an upper insert attached thereto said bifurcating upper central hinge of said second upper box supports;

a lower insert attached thereto said bifurcating lower central hinge of said second lower box supports;

wherein said upper and lower insert has a width which also corresponds thereto said desired bed size;

four (4) first platform boards supported thereby and attachable thereto said support structure, comprising rectangular shapes having a single rounded corner for positioning at each corner portion of said support structure and further comprising:

a flush edge thereto said support structure along a headboard end; and, an overhanging edge portion along three (3) remaining edges; and, a pair of second platform boards supported thereby and attachable thereto said support structure, comprising rectangular shapes and positioned therebetween said first platform boards thereon said support structure, such that said second platform boards provide a continuous flush edge therewith said first platform boards;

locating a desired room providing sufficient area in which to set up said assembly;

unfolding and expanding said support structure to form a rectangular periphery;

lifting said first box supports therefrom a floor surface;

affixing said first and second platform boards thereto said support structure using provided fasteners, thereby defining a mattress platform;

assembling said upper and lower inserts into said second upper and second lower second box supports, respectively, therewith a plurality of provided fasteners, to achieve said desired bed size;

placing said mattress thereupon said mattress platform; and, placing additional foot/headboard members, if desired.

13. The method of claim 12; further comprising the steps of:

providing said assembly further comprising:

an anti-skid cover comprising a plurality of first fastening means removably attaching thereto a plurality of second fastening means located therealong a top perimeter region of each of said first and second platform boards; and, attaching said anti-skid cover thereto said mattress platform boards by engaging said first and second fastening means.

14. The method of claim 12; further comprising the steps of:

providing said assembly further comprising:

a plurality of first slots located along inward facing surfaces of said first box supports;

a plurality of platform supports slidingly inserted therein said plurality of first slots;

a plurality of compartment doors hingedly connected thereto an outer surface of said pair of first box supports each comprising a knob and a secure closure mechanism;

a plurality of second slots extending horizontally located along a bottom inside edge of said first box supports;

a plurality of caster boards sized so as to slidingly insert an end portion of said caster board therein said plurality of second slots;

a pair of locking caster wheel assemblies attached thereto a bottom surface of each of said plurality of caster boards; and, a plurality of floorboards attachable thereto said plurality of caster boards and spanning said width of said support structure;

inserting said plurality of caster boards thereinto said plurality of second slots;

inserting said plurality of platform supports downwardly thereinto said plurality of first slots until contacting and resting thereon said plurality of caster boards; and, transporting said assembly thereto a desired location therewith said caster wheel assemblies.

15. A collapsible and transportable platform assembly for a mattress, further comprising:

a support structure, further comprising:

a pair of first box supports, comprising an upper end and a lower end;

a plurality of first slots located along inward facing surfaces of said first box supports;

a plurality of platform supports slidingly inserted therein said plurality of first slots;

a plurality of compartment doors hingedly connected thereto an outer surface of said pair of first box supports each comprising a knob and a secure closure mechanism;

a plurality of second slots extending horizontally located along a bottom inside edge of said first box supports;

a plurality of caster boards sized so as to slidingly insert an end portion of said caster board therein said plurality of second slots;

a pair of locking caster wheel assemblies attached thereto a bottom surface of each of said plurality of caster boards;

a plurality of floorboards attachable thereto said plurality of caster boards and spanning said width of said support structure;

a pair of second upper box supports hingedly attached thereto said upper end of said first box supports, further comprising a bifurcating upper central hinge; and, a pair of second lower box supports hingedly attached thereto said lower end of said first box supports, further comprising a bifurcating lower central hinge;

four (4) first platform boards supported thereby and attachable thereto said support structure, comprising rectangular shapes having a single rounded corner for positioning at each corner portion of said support structure and further comprising:

a flush edge thereto said support structure along a headboard end; and, an overhanging edge portion along three (3) remaining edges; and, a pair of second platform boards supported thereby and attachable thereto said support structure, comprising rectangular shapes and positioned therebetween said first platform boards thereon said support structure, such that said second platform boards provide a continuous flush edge therewith said first platform boards;

wherein when said support structure is fully extended a width and a confined space is defined thereof;

wherein said support structure hingedly collapses into a compact storage configuration;

wherein said plurality of first slots are spaced so as to provide an attachment means thereto and enable said platform supports to correspondingly span said width of said support structure;

wherein said plurality of first slots are spaced so as to divide said confined space of said support structure into equally-sized sections;

wherein said plurality of compartment doors are centrally positioned therein said equally-sized sections and provide access thereinto said confined space thereof said support structure;

wherein said plurality of second slots are spaced so as to provide an attachment means thereto and enable said caster boards to correspondingly span said width of said support structure;

wherein said plurality of floorboards provide a suitable bottom horizontal surface thereof said support structure;

wherein said first platform boards and second platform boards when installed to establish a continuous flat surface combine to form a mattress platform; and, wherein said mattress platform supports said mattress laid thereupon at a typical distance above a floor surface.

16. The assembly of claim 15, further comprising an anti-skid cover comprising an attachment means thereto said mattress platform;

wherein said anti-skid cover has a plurality of first fastening means removably attaching thereto a plurality of second fastening means located therealong a top perimeter region of each of said first and second platform boards therefore.

17. The assembly of claim 15, wherein said first and second platform boards comprise dimensions corresponding to conventional bed sizes consisting of one of the following list: single, double, queen, and king.

18. The assembly of claim 15, further comprising:

an upper insert attached thereto said bifurcating upper central hinge of said second upper box supports; and, a lower insert attached thereto said bifurcating lower central hinge of said second lower box supports;

wherein said upper insert and said lower insert provide a variable width means thereto said support structure.

* * * * *